US011304447B2

(12) United States Patent
Mead et al.

(10) Patent No.: US 11,304,447 B2
(45) Date of Patent: Apr. 19, 2022

(54) VAPING DEVICE

(71) Applicant: Catherine R. Mead, Cochise, AZ (US)

(72) Inventors: Catherine R. Mead, Cochise, AZ (US); Katelyn Urso, Cochise, AZ (US)

( * ) Notice: Subject to any disclaimer, the term of this patent is extended or adjusted under 35 U.S.C. 154(b) by 365 days.

(21) Appl. No.: 16/400,852

(22) Filed: May 1, 2019

(65) Prior Publication Data

US 2019/0335811 A1 Nov. 7, 2019

Related U.S. Application Data

(63) Continuation-in-part of application No. 29/646,107, filed on May 1, 2018, now Pat. No. Des. 877,408.

(60) Provisional application No. 62/665,419, filed on May 1, 2018.

(51) Int. Cl.

| | |
|---|---|
| ***A24F 3/00*** | (2006.01) |
| ***A24F 7/00*** | (2006.01) |
| ***A24F 40/40*** | (2020.01) |
| ***A24F 40/60*** | (2020.01) |
| *A24F 40/90* | (2020.01) |
| *A24F 40/20* | (2020.01) |

(52) U.S. Cl.

CPC ..... *A24F 3/00* (2013.01); *A24F 7/00* (2013.01); *A24F 40/40* (2020.01); *A24F 40/60* (2020.01); *A24F 40/20* (2020.01); *A24F 40/90* (2020.01)

(58) Field of Classification Search

None

See application file for complete search history.

(56) References Cited

U.S. PATENT DOCUMENTS

2018/0043115 A1* 2/2018 Gould ..... A61M 11/00

* cited by examiner

*Primary Examiner* — Michael J Felton
*Assistant Examiner* — Katherine A Will
(74) *Attorney, Agent, or Firm* — Schmeiser, Olsen & Watts LLP

(57) ABSTRACT

A vaping device is provided. The vaping device may include a main body with a flip lid hingedly coupled to the main body. The main body may include a pod removably coupled within the main body. The pod may have an interior volume for receiving and retaining concentrated plant extract. The main body may also include a heating element for vaporizing the concentrated plant extract. The main body may include a mouthpiece for inhaling vapor from the concentrated plant extract. Further, the main body may include a power source for providing power to the heating element and a button for engaging power from the power source to the heating element. A method of using a vaping device is also disclosed.

20 Claims, 6 Drawing Sheets

VAPING DEVICE

CROSS REFERENCE TO RELATED APPLICATION[S]

This application claims priority to U.S. Provisional Patent Application to Catherine R. Mead, entitled "Vaping Device," Ser. No. 62/665,419, filed May 1, 2018, and is a continuation-in-part of U.S. Patent Application to Catherine R. Mead, entitled "Vaping Device," Ser. No. 29646107, filed on May 1, 2018, the disclosures of which are hereby incorporated entirely herein by reference.

BACKGROUND OF THE INVENTION

Technical Field

This invention relates generally to vaping device and more particularly to a vaping device for use with concentrated plant extracts.

State of the Art

The use of vaping devices is increasing. It is a convenient and efficient way of delivering the benefits of plant extracts to a user in vapor form. Conventional vaping devices have drawbacks in the portability of the vaping device. Often the activation mechanisms of conventional vaping devices are accidentally activated and result in loss of plant extract. Further, users are limited in the ways the vaping device can be carried without activating the device.

Accordingly, there is a need for an improved vaping device.

SUMMARY OF THE INVENTION

The present invention relates to vaping devices for use with concentrated plant extracts.

An embodiment includes a vaping device comprising: a main body with a flip lid hingedly coupled to the main body, the main body comprising: a pod removably coupled within the main body, the pod having an interior volume for receiving and retaining concentrated plant extract; a heating element for vaporizing the concentrated plant extract; a mouthpiece for inhaling vapor from the concentrated plant extract; a power source for providing power to the heating element; and a button for engaging power from the power source to the heating element.

In some embodiments, the main body comprises an upper section and a lower section rotatably coupled to the upper section, such that the lower section may rotate with respect to the upper section between a heating position and a dabbing position, wherein the pod is removably coupled to an interior surface of the lower section. While in the heating position, the heating element is positioned beneath the dabbing nail such that the dabbing nail may contact the heating element when the mouthpiece is depressed by the user. While in the dabbing position, the pod is positioned beneath the dabbing nail such that the dabbing nail may contact the concentrated plant extract.

A method of using a vaping device is also disclosed.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
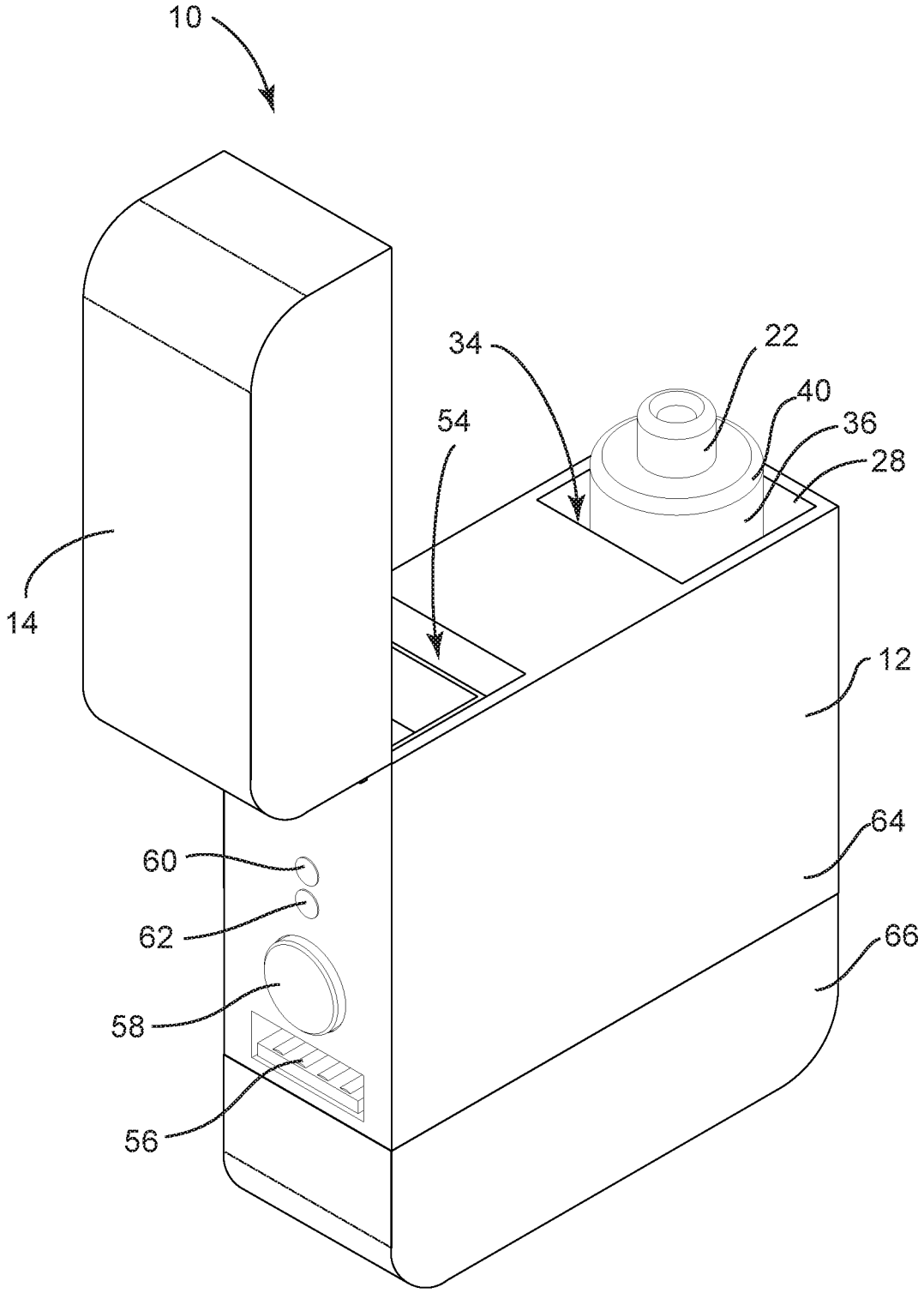
FIG. 1 is a perspective view of a vaping device in accordance with an embodiment.

As discussed above, embodiments of the present invention relate to a vaping device for concentrated plant extracts.

FIGS. 1-5 depict a vaping device 10 in accordance with embodiments. Some embodiments include a main body 12 with a flip lid 14 hingedly coupled to the main body 12; the main body 12 further comprising a pod 16 removably coupled within the main body 12; the pod 16 having an interior volume adapted for storage of concentrated plant extract 18; a heating element 20 for vaporizing the concentrated plant extract 18 by means, such as conduction, convection, dabbing, or the like; a mouthpiece 22 for inhaling vapor from the concentrated plant extract 18; a power source for providing power to the heating element 20; and a button for engaging power from the power source to the heating element 20. In some embodiments, the flip lid 14 may transition between an open position and a closed position, such that the flip lid 14 covers the mouthpiece 22 and the button, while in the closed position, to protect the mouthpiece 22 and to prevent power from being engaged to the heating element 20 by inadvertent pressing of the button while not in use. In some embodiments, the mouthpiece 22 is the button.

In some embodiments, the flip lid 14 is coupled to the main body 12 with a spring hinge, such as a spring-cam-lever mechanism, or the like, such that the spring hinge tends to hold the flip lid 14 in place while in the closed position with no external force applied, and also tends to hold the flip lid 14 in place while in the open position with no external force applied.

Figure 2:
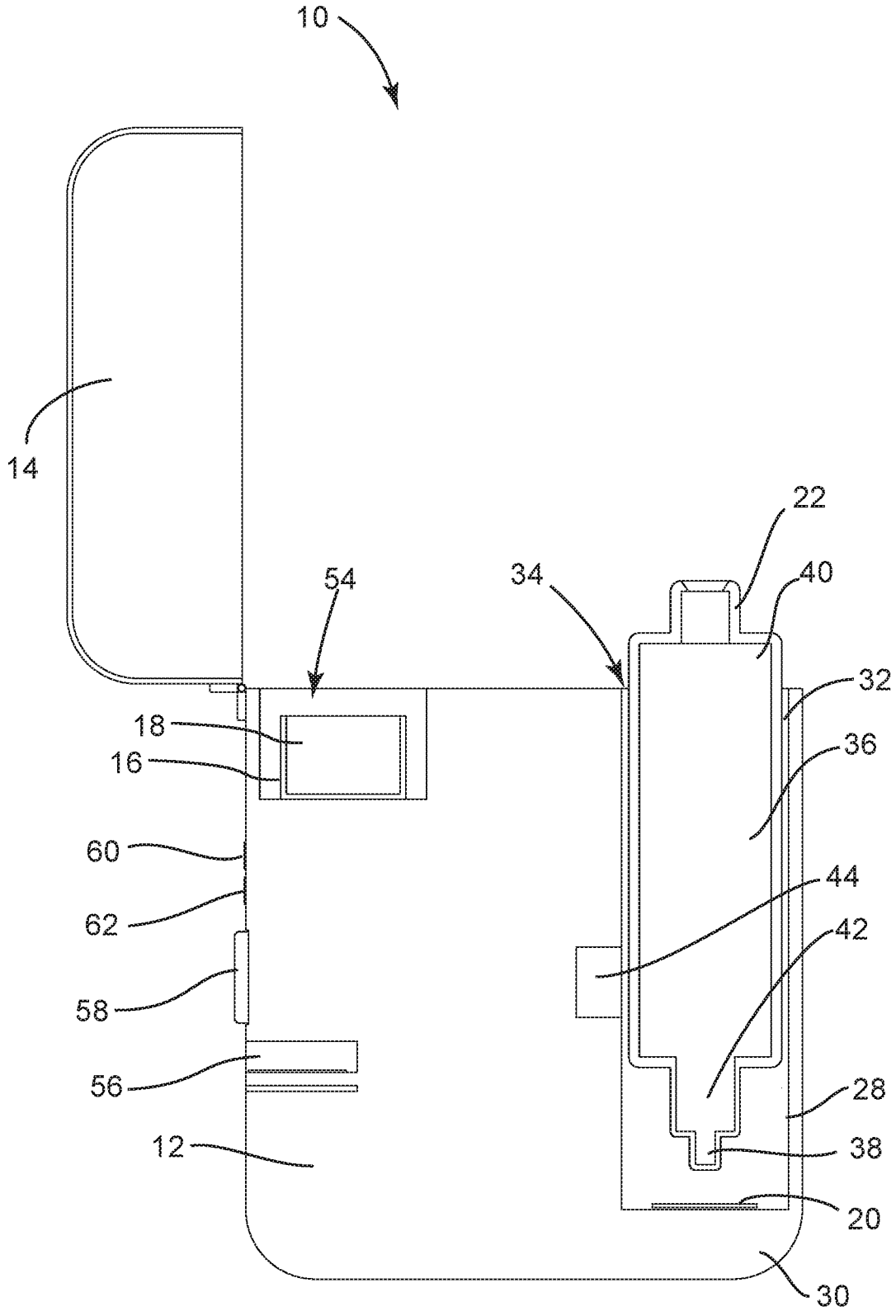
FIG. 2 is a section view of a vaping device in accordance with an embodiment.

As shown in FIG. 2, an embodiment of the vaping device 10 includes a main body 12 comprising an elongated passage 28 with opposed lower and upper ends 30 and 32, respectively. A heating element 20 is coupled to the lower end 30 of the elongated passage 28. The upper end 32 of the elongated passage 28 is accessible through an opening 34 in the main body 12. The elongated passage 28 receives a nectar collector 36 of generally elongated tubular shape. The nectar collector 36 comprises a mouthpiece 22 removably coupled to the upper end 40 thereof and a dabbing nail 38 removably coupled to the lower end 42 thereof. The nectar collector 36 may slide through the opening 34 of the main body 12 and into the elongated passage 28, such that the mouthpiece 22 protrudes out of the upper end 32 of the elongated passage 28 and the dabbing nail 38 is in a position to be moved into contact with the heating element 20 at the lower end 30 of the elongated passage 28.

In some embodiments, the dabbing nail 38 is made of titanium. It will be understood that the dabbing nail 38 may be made of other material, such as, but not limited to glass, quartz, ceramic or any other material suitable for use as a dabbing nail.

A latch mechanism 44 comprises a spring, a latching device, and a triggering device. The spring may be coupled to the elongated passage 28 and engages the nectar collector 36 to prevent the dabbing nail 38 from contacting the heating element 20 with no external force. The dabbing nail 38 may contact the heating element 20 in reaction to a downward force on the mouthpiece 22 by a user. The latching device may be coupled to the elongated passage 28. The latching device is engaged when a user exerts a downward force on the mouthpiece 22 and places the dabbing nail 38 in contact with the heating element 20, to hold the nectar collector 36 in place, the resulting downward force of the nectar collector 36 compressing the spring, such that the dabbing nail 38 is held in contact with the heating element 20, such that the dabbing nail 38 may be heated by the heating element 20, such as by conduction. The triggering device may be a temperature sensor, or the like, which operates in response to heat from the dabbing nail 38 to release the latching device when the dabbing nail 38 attains a predetermined temperature, thereby disengaging the dabbing nail 38 from the heating element 20. It will be understood that the predetermined temperature may be a temperature sufficient to vaporize the concentrated plant extract 18 upon contact with the dabbing nail 38.

In some embodiments, the nectar collector 36 is made of glass. In some embodiments, the nectar collector 36 is made of any other material that is suitable for use as a nectar collector. Heat from the dabbing nail 38 may be further conducted to the nectar collector 36, heating the nectar collector 36 to a temperature sufficient to burn a user who touches the nectar collector 36. In some embodiments, the nectar collector 36 further comprises an insulating surface coupled around the nectar collector 36, such that a user may grasp the insulating surface to manipulate the nectar collector 36, to prevent the user being burned by touching the nectar collector 36 while hot.

In some embodiments, the main body 12 further comprises a recess 54, adapted to receive a pod 16, removably coupled to the main body 12 at the recess 54. The pod 16 has an interior volume for receiving and retaining concentrated plant extract 18 and making it accessible through the recess 54.

The main body 12 further comprises a power source for providing power to the heating element 20. In some embodiments, the power source is a battery. In some embodiments the battery is a rechargeable battery. In some embodiments, the main body 12 comprises a Universal Serial Bus ("USB") outlet 56, connected to a charging device that is used to the recharge an onboard rechargeable battery, such that the rechargeable battery may be charged when the USB outlet 56 is connected to an exterior power source. In some embodiments, the main body 12 comprises a switch 58 to engage or disengage power from the power source to the heating element 20. In some embodiments, the main body 12 comprises a first indicator light 60 that illuminates when power is engaged from the power source to the heating element 20 and ends illumination when power is disengaged from the power source to the heating element 20. In some embodiments, the main body 12 comprises a second indicator light 62 that illuminates when the dabbing nail 38 has attained the predetermined temperature and ends illumination when the temperature of the dabbing nail 38 is below the predetermined temperature.

Figure 3:
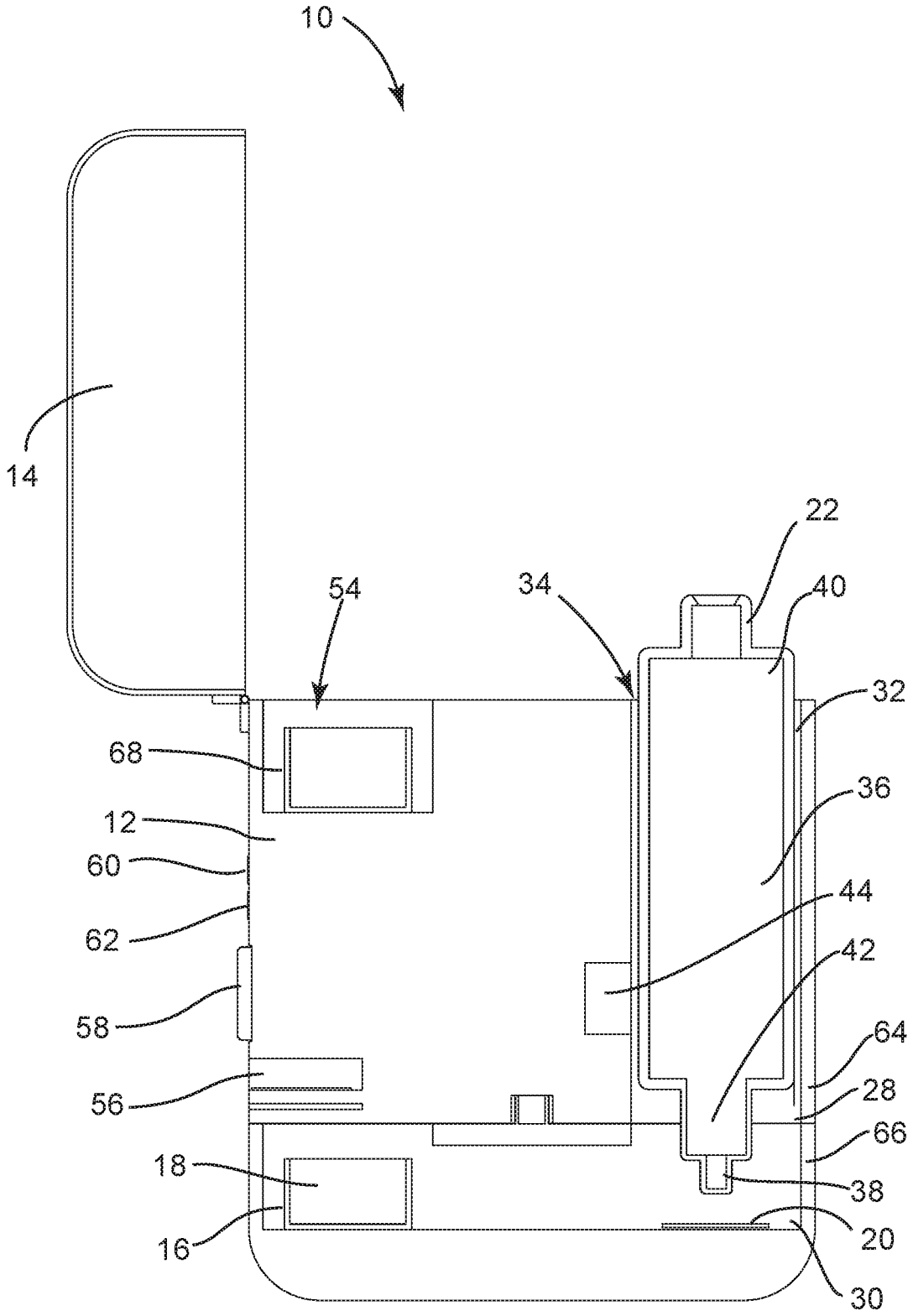
FIG. 3 is a section view of a vaping device with a rotatable bottom portion in accordance with an embodiment.
Figure 4:
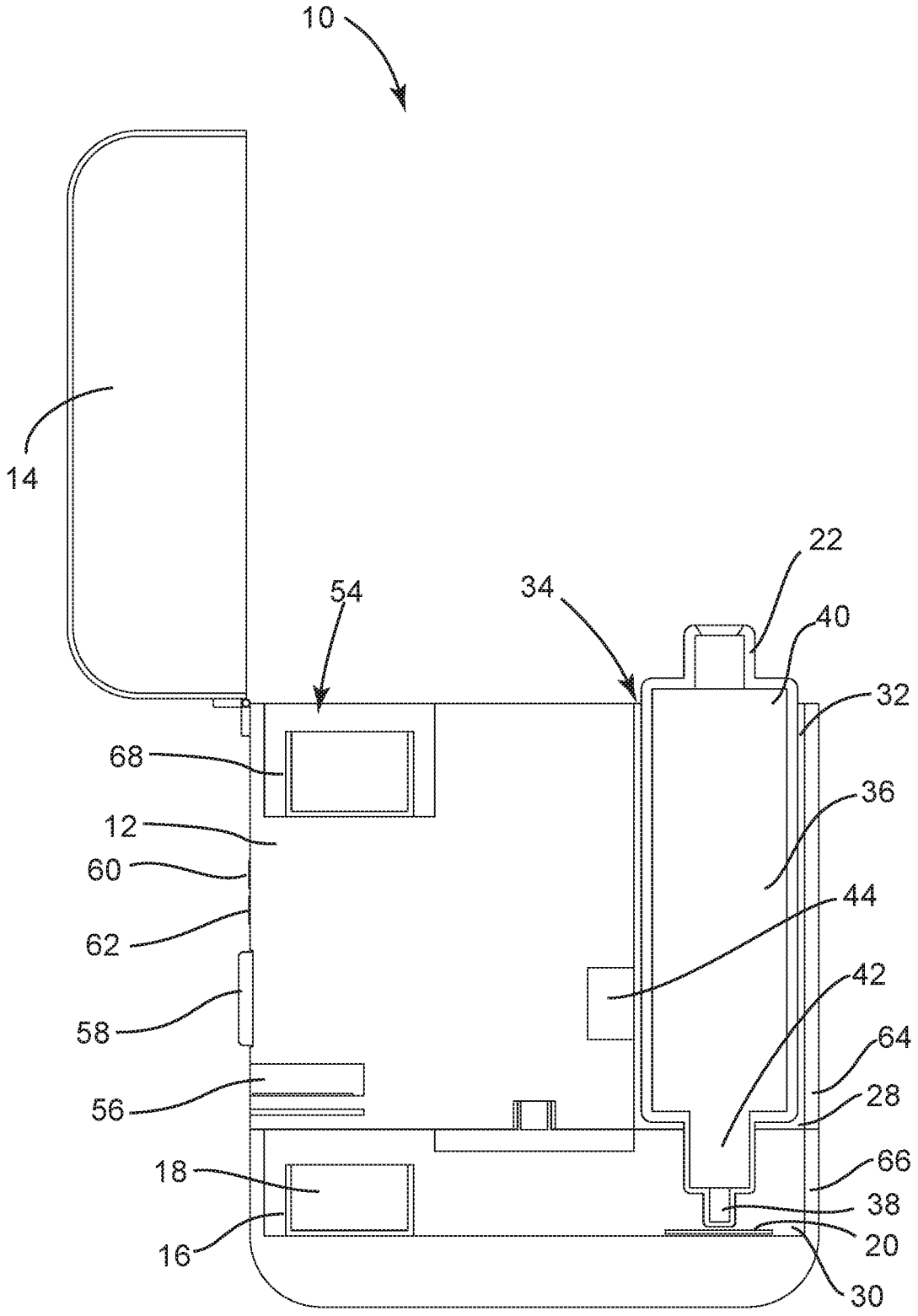
FIG. 4 is another section view of a vaping device with a rotatable bottom portion in accordance with an embodiment.

In some embodiments, the user may depress the mouthpiece 22, causing the dabbing nail 38 to contact the heating element 20, as shown in FIG. 4, thus heating the dabbing nail 38 to the predetermined temperature. When the dabbing nail 38 reaches the predetermined temperature, the latch is released by the triggering mechanism, and the dabbing nail 38 is returned to its original position, as shown in FIG. 3. The user may then remove the nectar collector 36 by grasping the mouthpiece 22 to pull the nectar collector 36 out of the elongated passage 28. The user may then position the nectar collector 36 such that the dabbing nail 38 contacts the concentrated plant extract 18. When the dabbing nail 38 is at a predetermined temperature sufficient to vaporize the concentrated plant extract 18, the dabbing nail 38 will vaporize the concentrated plant extract 18 when placed in contact with it. Vapors from the concentrated plant extract 18 may then be inhaled by the user with the mouthpiece 22 as vapor travels through nectar collector 36 and through the mouthpiece 22 to the user.

Figure 5:
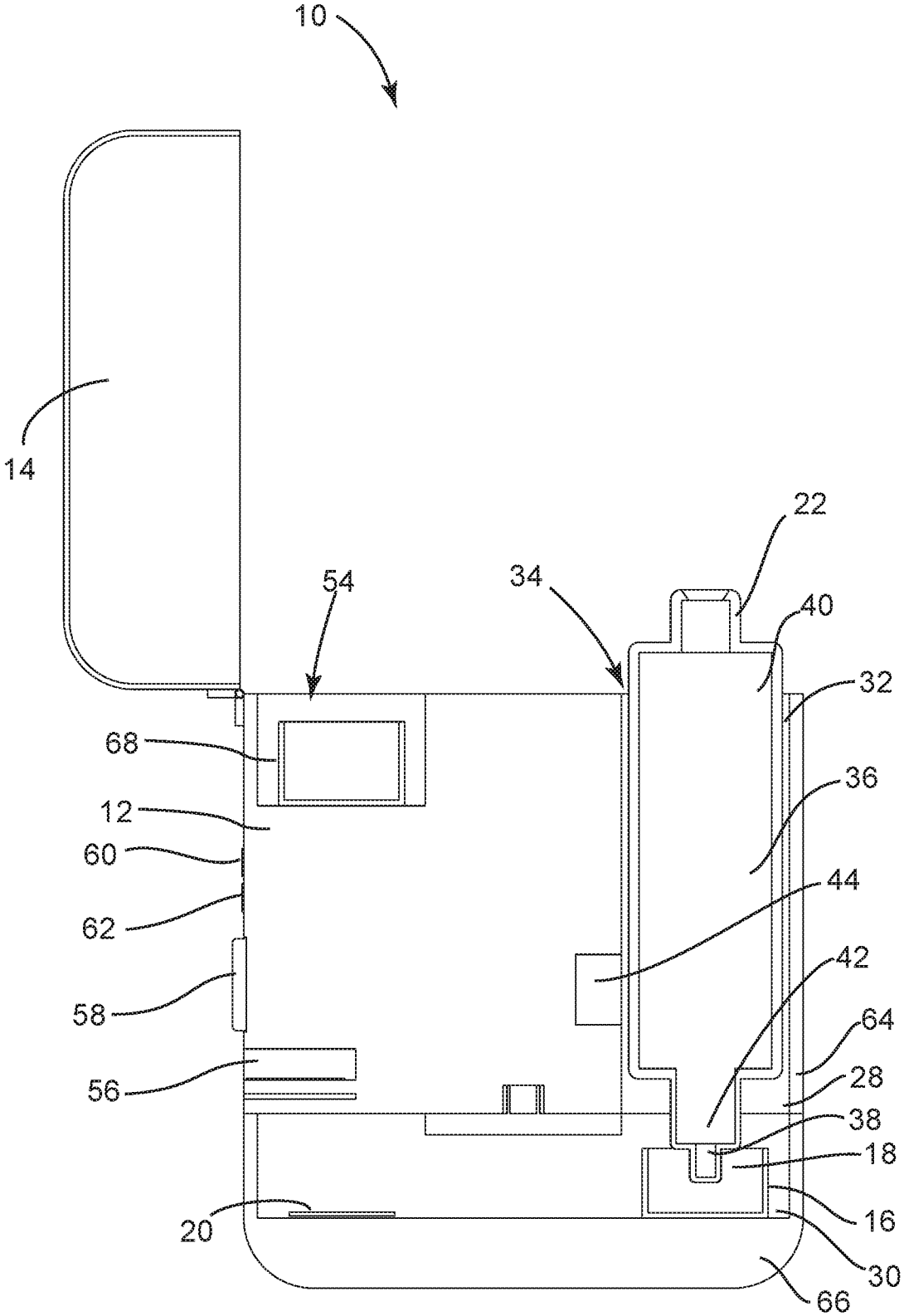
FIG. 5 is yet another section view of a vaping device with a rotatable bottom portion in accordance with an embodiment.

As shown in FIGS. 1 and 3-5, in some embodiments, the main body 12 comprises an upper section 64 and a lower section 66 rotatably coupled to the upper section 64, such that the lower section 66 may rotate with respect to the upper section 64 between a heating position, as shown in FIGS. 3 and 4, and a dabbing position, as shown in FIG. 5, wherein the pod 16 is removably coupled to an interior surface of the lower section 66. While in the heating position, the heating element 20 is positioned beneath the dabbing nail 38 such that the dabbing nail 38 may contact the heating element 20 when the mouthpiece 22 is depressed by the user. While in the dabbing position, the pod 16 is positioned beneath the dabbing nail 38 such that the dabbing nail 38 may contact the concentrated plant extract 18.

With the lower section in the heating position, the user may depress the mouthpiece 22, causing the dabbing nail 38 to contact the heating element 20, thus heating the dabbing nail 38 to the predetermined temperature. When the dabbing nail 38 reaches the predetermined temperature, the latch is released by the triggering mechanism, and the dabbing nail 38 is returned to its original position. The user may then rotate the lower section 66 from the heating position to the dabbing position. The user may then depress the mouth piece causing the dabbing nail 38 to contact the concentrated plant extract 18. With the dabbing nail 38 at a predetermined temperature sufficient to vaporize the concentrated plant extract 18, the dabbing nail 38 vaporizes the concentrated plant extract 18 when placed in contact with it. Vapors from the concentrated plant extract 18 may then be inhaled by the user with the mouthpiece 22 as vapor travels through nectar collector 36 and through the mouthpiece 22 to the user.

In some embodiments, the mouthpiece 22 may be telescoping, such that a user may grasp the mouthpiece and pull to extend the mouthpiece to an extended configuration.

In some embodiments, the main body 12 comprises at least one recess 54, adapted to receive and store at least one second pod 68, removably coupled to the main body 12 at the at least one recess 54.

Figure 6:
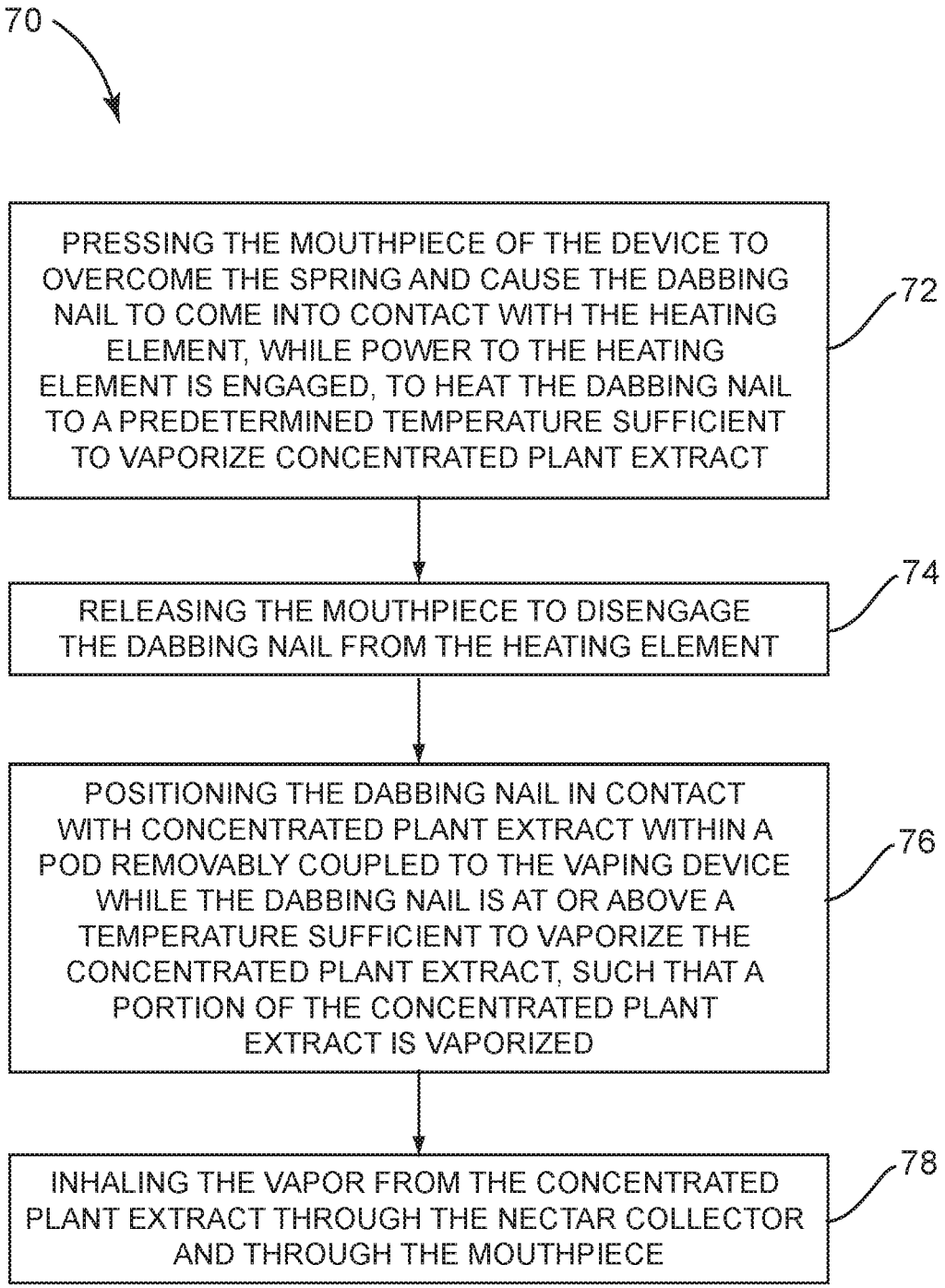
FIG. 6 is a block diagram showing steps of a method of using a vaping device in accordance with an embodiment.

FIG. 6 is a block diagram of steps of a method 70 of using a vaping device, comprising: pressing the mouthpiece of the device to overcome the spring and cause the dabbing nail to come into contact with the heating element, while power to the heating element is engaged, to heat the dabbing nail to a predetermined temperature sufficient to vaporize concentrated plant extract (Step 72); releasing the mouthpiece to disengage the dabbing nail from the heating element (Step 74); positioning the dabbing nail in contact with concentrated plant extract within a pod removably coupled to the vaping device while the dabbing nail is at or above a temperature sufficient to vaporize the concentrated plant extract, such that a portion of the concentrated plant extract is vaporized (Step 76); and inhaling the vapor from the concentrated plant extract through the nectar collector and through the mouthpiece (Step 78).

The method of using a vaping device may further comprise pressing a button to engage power to the heating element. In some embodiments of the method, the button is the mouthpiece. The method may further comprise the additional steps of rotating a lower body of the vaping device between a heating orientation and a dabbing orientation and transitioning a flip lid of the vaping device between an open orientation and a closed orientation.

The above discussion notwithstanding, various components defining any vaping device may be formed of any of many different types of materials or combinations thereof that can readily be formed into shaped objects provided that the components selected are consistent with the intended operation of a vaping device for concentrated plant extracts. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any vaping device for concentrated plant extracts may be purchased pre-manufactured or manufactured separately and then assembled together. However, any or all the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A vaping device comprising:

a main body;

a passage within the main body, the passage having an upper end and a lower end, the upper end thereof being accessible through an opening in the main body;

a heating element coupled to the lower end of the passage;

a power source coupled to the heating element, the power source having a button coupled thereto for controlling power to the heating element;

a nectar collector having a first end and a second end;

a mouthpiece coupled to the first end of the nectar collector, the mouthpiece being configured for a user to inhale vapor from concentrated plant extract in the nectar collector;

a dabbing nail coupled to the second end of the nectar collector, wherein the nectar collector is removably inserted into the passage through the opening in the main body such that the mouthpiece protrudes out through the opening;

a latch mechanism, further comprising:

a spring coupled between the passage and the nectar collector, wherein the force of the spring prevents the dabbing nail from contacting the heating element when no external force is applied to the mouthpiece and wherein the spring force may be overcome by a user applying force to the mouthpiece, thereby causing the dabbing nail to come into contact with the heating element;

a latching device coupled to the passage, wherein the latching device is engaged to hold the nectar collector in place, with the dabbing nail in contact with the heating element, in response to a user applying force to the mouthpiece; and a triggering device coupled to the latching device, wherein the triggering device operates, in response to heat conducted thereto from the heating element when power to the heating element is engaged, to release the latching device when the dabbing nail attains a predetermined temperature, thereby disengaging the dabbing nail from the heating element; and at least one recess in the main body, the at least one recess being configured for receiving at least one pod removably coupled therein, wherein the at least one pod has an interior volume for receiving and retaining concentrated plant extract, wherein the concentrated plant extract is accessible through the recess.

2. The vaping device of claim 1, further comprising a flip lid hingedly coupled to the main body, wherein the flip lid may be transitioned between an open and a closed position, wherein the mouthpiece is concealed within the flip lid while in the closed position and the mouthpiece is exposed while in the open position.

3. The vaping device of claim 2, wherein the flip lid is coupled to the main body by a spring hinge.

4. The vaping device of claim 1, wherein the button coupled to the power source for controlling power to the heating element is the mouthpiece, wherein power to the heating element is engaged when a user applies force to the mouthpiece to engage the latching device, and power to the heating element is disengaged when the latching device is released.

5. The vaping device of claim 1, wherein the power source is a rechargeable battery.

6. The vaping device of claim 5, further comprising a Universal Serial Bus outlet coupled to the main body and coupled to the rechargeable battery, wherein the rechargeable battery may be charged when the Universal Serial Bus outlet is connected to an exterior power source.

7. The vaping device of claim 1, further comprising at least one of:

a first indicator light, the first indicator light being configured to illuminate when power is engaged to the heating element; and a second indicator light, the second indicator light being configured to illuminate when the dabbing nail is at or above a predetermined temperature.

8. The vaping device of claim 1, wherein the mouthpiece is a telescoping mouthpiece that may be transitioned between an extended orientation and a non-extended orientation.

9. A vaping device comprising:

a main body;

a lower body rotatably coupled to the main body, the lower body having a heating element side and a pod storage side, wherein the lower body is rotatable with respect to the main body between a heating orientation and a dabbing orientation;

a passage through the main body, the passage having an upper end and a lower end, the upper end thereof being accessible through a first opening in the main body and the lower end thereof being accessible through a second opening in the main body;

a heating element coupled to the pod storage side of the lower body such that the heating element is disposed directly below the lower end of the passage while the lower body is in the heating orientation;

a primary pod having an interior volume for receiving and retaining concentrated plant extract, the primary pod being removably coupled to the pod storage side of the lower body such that the primary pod is disposed directly below the lower end of the passage while the lower body is in the dabbing orientation, wherein the concentrated plant extract is accessible from the passage;

a power source coupled to the heating element, the power source having a button coupled thereto for controlling power to the heating element;

a nectar collector having a first end and a second end;

a mouthpiece coupled to the first end of the nectar collector, the mouthpiece being configured for a user to inhale vapor from concentrated plant extract in the nectar collector;

a dabbing nail coupled to the second end of the nectar collector, wherein the nectar collector is removably inserted into the passage through the first opening in the main body such that the mouthpiece protrudes out through the first opening;

a latch mechanism, further comprising:

a spring coupled between the passage and the nectar collector, wherein, while the lower body is in the heating orientation, the force of the spring prevents the dabbing nail from contacting the heating element when no external force is applied to the mouthpiece and wherein the spring force may be overcome by a user applying force to the mouthpiece, thereby causing the dabbing nail to come into contact with the heating element, and, while the lower body is in the dabbing orientation, the force of the spring prevents the dabbing nail from contacting the concentrated plant extract when no external force is applied to the mouthpiece and wherein the spring force may be overcome by a user applying force to the mouthpiece, thereby causing the dabbing nail to come into contact with the concentrated plant extract, wherein, while the dabbing nail is at or above a temperature sufficient to vaporize the concentrated plant extract, a portion of the concentrated plant extract is vaporized upon contact of the concentrated plant extract with the dabbing nail such that a user may inhale vapors from the concentrated plant extract through the nectar collector and through the mouthpiece;

a latching device coupled to the passage, wherein, while the lower body is in the heating orientation, the latching device is engaged to hold the nectar collector in place, with the dabbing nail in contact with the heating element, in response to a user applying force to the mouthpiece; and a triggering device coupled to the latching device, wherein, while the lower body is in the heating orientation, the triggering device operates, in response to heat conducted thereto from the heating element when power to the heating element is engaged, to release the latching device when the dabbing nail attains a predetermined temperature, thereby disengaging the dabbing nail from the heating element; and at least one recess in the main body, the at least one recess being configured for receiving at least one secondary pod removably coupled therein, wherein the at least one secondary pod has an interior volume for receiving and retaining concentrated plant extract, wherein the concentrated plant extract is accessible through the recess, wherein the primary pod and the at least one secondary pod are interchangeable.

10. The vaping device of claim 9, further comprising a flip lid hingedly coupled to the main body, wherein the flip lid may be transitioned between an open and a closed position, wherein the mouthpiece is concealed within the flip lid while in the closed position and the mouthpiece is exposed while in the open position.

11. The vaping device of claim 10, wherein the flip lid is coupled to the main body by a spring hinge.

12. The vaping device of claim 9, wherein the button coupled to the power source for controlling power to the heating element is the mouthpiece, wherein power to the heating element is engaged when a user applies force to the mouthpiece to engage the latching device, and power to the heating element is disengaged when the latching device is released.

13. The vaping device of claim 9, wherein the power source is a rechargeable battery.

14. The vaping device of claim 13, further comprising a Universal Serial Bus outlet coupled to the main body and coupled to the rechargeable battery, wherein the rechargeable battery may be charged when the Universal Serial Bus outlet is connected to an exterior power source.

15. The vaping device of claim 9, further comprising at least one of:

a first indicator light, the first indicator light being configured to illuminate when power is engaged to the heating element; and a second indicator light, the second indicator light being configured to illuminate when the dabbing nail is at or above a predetermined temperature.

16. A method of using a vaping device, comprising:

pressing a mouthpiece of the device to overcome a spring and cause a dabbing nail to come into contact with a heating element, while power to the heating element is engaged, to heat the dabbing nail to a predetermined temperature sufficient to vaporize concentrated plant extract;

releasing the mouthpiece to disengage the dabbing nail from the heating element;

positioning the dabbing nail in contact with concentrated plant extract within a pod removably coupled to the vaping device while the dabbing nail is at or above a temperature sufficient to vaporize the concentrated plant extract, such that a portion of the concentrated plant extract is vaporized; and inhaling the vapor from the concentrated plant extract through a nectar collector and through the mouthpiece.

17. The method of using a vaping device of claim 16, further comprising pressing a button to engage power to the heating element.

18. The method of using a vaping device of claim 17, wherein the button is the mouthpiece.

19. The method of using a vaping device of claim 16, further comprising rotating a lower body of the vaping device between a heating orientation and a dabbing orientation.

20. The method of using a vaping device of claim 16, further comprising transitioning a flip lid of the vaping device between an open orientation and a closed orientation.

* * * * *